United States Patent [19]

Rathbone

[11] Patent Number: 5,040,370

[45] Date of Patent: Aug. 20, 1991

[54] INTEGRATED AIR SEPARATION/METALLURGICAL PROCESS

[75] Inventor: Thomas Rathbone, Farnham, United Kingdom

[73] Assignee: The BOC Group, plc., Surrey, England

[21] Appl. No.: 533,747

[22] Filed: Jun. 6, 1990

[30] Foreign Application Priority Data

Jun. 6, 1989 [GB] United Kingdom ..... 8913001

[51] Int. Cl.[5] ..... F01K 25/10

[52] U.S. Cl. ..... 60/648; 60/671; 60/649

[58] Field of Search ..... 60/651, 671, 648, 649; 62/50.3

[56] References Cited

U.S. PATENT DOCUMENTS

| | | | |
|---|---|---|---|
| 3,241,327 | 3/1976 | LaFleur . | |
| 3,950,957 | 4/1976 | Zakon | 60/648 X |
| 3,987,632 | 10/1976 | Pereda | 60/671 |
| 3,987,633 | 10/1976 | Ford, Jr. | 60/671 |
| 4,697,413 | 10/1987 | Pohl . | |
| 4,697,415 | 10/1987 | Schiffers . | |
| 4,729,217 | 3/1988 | Kehlhofer . | |

FOREIGN PATENT DOCUMENTS

| | | | |
|---|---|---|---|
| 0282321 | 10/1988 | European Pat. Off. . | |
| 1102122 | 7/1958 | Fed. Rep. of Germany . | |
| 27153 | of 1898 | United Kingdom | 60/671 |
| 17692 | of 1899 | United Kingdom | 60/671 |

*Primary Examiner*—Allen M. Ostrager

*Attorney, Agent, or Firm*—Robert I. Pearlman; David M. Rosenblum

[57] ABSTRACT

Air is separated into oxygen and nitrogen in rectification columns 28 and 30. A stream of nitrogen is withdrawn from the top of the column 30 through an outlet 54, is warmed to about ambient temperature by passage through heat exchangers 34, 46 and 24, and is then heated at a pressure in the range 2 to 7 atmospheres absolute by heat exchange in heat exchanger 56 with a hot stream of fluid initially at a temperature of less than 600° C. without said fluid undergoing a change of phase. The resulting hot nitrogen is then expanded in turbine 58 with the performance of external work, e.g. the generation of electricity.

11 Claims, 2 Drawing Sheets

INTEGRATED AIR SEPARATION/METALLURGICAL PROCESS

TECHNICAL FIELD

This invention relates to air separation.

BACKGROUND OF THE PRIOR ART

It is known to be advantageous in certain circumstances to recover work from nitrogen produced in a cryogenic air separation plant. Most proposals for so doing are dependent upon the presence of a gas turbine employed to drive an alternator to generate electricity. See for example U.S. Pat. Nos. 2,520,862 and 3,371,495 in which compressed nitrogen is employed to control the pressure in the combustion chamber associated with the gas turbine, and energy is then recovered in the expansion of the gas. Accordingly, most if not all of the energy requirements of the air separation process can be met thereby. Frequently, however, a suitable gas turbine is not available on site to enable such processes to be used.

In UK patent specification 1,455,960 there is described an alternative process for recovering work from the nitrogen product. This method involves a thermodynamic linking of the air separation plant with a steam generator. The nitrogen product is heat exchanged with flue gases intended for generation of the steam in the steam generator so as to impart high grade heat to the nitrogen product and thus heat it to a temperature greater than 600°. The nitrogen is then work expanded to convert most of its required heat energy into the mechanical energy. Steam is generated by the flue gases downstream of their heat exchange with the nitrogen product. Residual, available heat in the work-expanded nitrogen product is used to reheat fluids re-entering the steam generator.

The process described in UK patent specification 1,455,960 has a number of drawbacks. First, the use of high-grade heat to raise steam is relatively inefficient. Second, there is a significant cost involved in steam raising. Third, although there is the potential to use work recovered from the air separation process to generate large excess quantities of electricity for export, the process according to UK 1,455,960 does not avail itself to this possibility. Fourth, suitable steam generation plant may frequently not be available on the site of the air separation plant. Fifth, there may not be readily available a suitable source of high grade heat, and if there is, there may be more efficient ways of using it. Sixth, the process is unable to utilize low grade heat which is more commonly available from industrial processes (but which is generally wasted or used only inefficiently for power generation).

SUMMARY OF THE INVENTION

The present invention relates to a method and apparatus for recovering work from a nitrogen stream, in which the nitrogen is preheated by heat exchange with a fluid stream embodying low grade heat (i.e., at a temperature of 600° C. or less) typically generated from a chemical or other process in which the oxygen product of the air separation partakes.

According to the present invention there is provided a process in which air is separated into oxygen and nitrogen., a stream of nitrogen at a pressure in the range of 2–7 atmospheres absolute is heated by heat exchange with a stream of fluid initially at a temperature of less than 600°, without said fluid undergoing a change of phase, and the thus heated nitrogen stream is expanded in a turbine with the performance of external work.

The invention also provides apparatus for performing the above method, comprising means for separating air into oxygen and nitrogen, a heat exchanger for heat exchanging a stream of nitrogen produced by the air separation means and at a pressure in the range of 2 to 7 atmospheres with a stream of fluid embodying initially at a temperature of less than 600° C. without said fluid undergoing a change of phase; and an expansion turbine for expanding the thus heated nitrogen with the performance of external work.

The external work performed in the method according to the invention may be the compression of an air stream entering or product stream leaving the air separation process but is preferably the generation of electricity for another process then the air separation or for export.

The stream of fluid is preferably initially (i.e., before heat exchange) at a temperature in the range 200°–400°, and more preferably in the range 300°–400° C. It is not usually possible to recover work efficiently from such streams and therefore the invention is advantageous in providing a unique and relatively efficient way of recovering work.

Typically, the stream at a temperature 600° C. or less is a waste gas stream from an industrial or chemical process in which said oxygen is used or alternatively heat may be available from an industrial process where there is a requirement to cool a process stream. The heat exchange is preferably performed in a direct gas-to-gas heat exchanger. Another alternative is to use the fluid stream from an industrial or chemical process to raise the temperature of a heat transfer medium (without changing its state) and use the medium to heat the nitrogen by direct heat exchange, without the medium change state. The medium may be a heat transfer oil.

The optimum pressure at which the nitrogen is brought into heat exchange relationship with the fluid stream depends on the temperature of the fluid stream. The higher the temperature of the fluid stream, the higher the preferred nitrogen stream pressure, so that at about 400° the preferred nitrogen pressure is approximately 4 atmospheres. Typically, the nitrogen stream is employed at a pressure in the range 2 to 5 atmospheres, particularly if the fluid stream is initially at a temperature in the range 200° to 400° C.

The nitrogen may be raised to the desired pressure by means of a compressor. Alternatively, the distillation column or columns used to separate the air may be arranged and operated such that the nitrogen stream is produced at the required elevated pressure or a pressure a little there above so that no nitrogen compressor is required. Indeed, if the air is separated in a double column of the conventional kind as described in Ruhemann's "Separation of Gases", Oxford University Press, 1945, the lower pressure column may advantageously be operated at a pressure of from 3 to 4 atmospheres absolute. Upstream of being heat exchanged with the fluid stream, the nitrogen stream is typically used to regenerate apparatus used to remove water vapor and other relatively non-volatile components from the air for separation, be such apparatus of the reverse in heat exchange kind or of the adsorbent kind.

The oxygen separated from the air may typically be used in a chemical, metallurgical or other industrial process from which the waste heat is generated.

BRIEF DESCRIPTION OF THE DRAWINGS

The method and apparatus according to the invention will now be described by way of example with reference to the accompanying drawings in which.

DETAILED DESCRIPTION OF THE INVENTION

Figure 1:
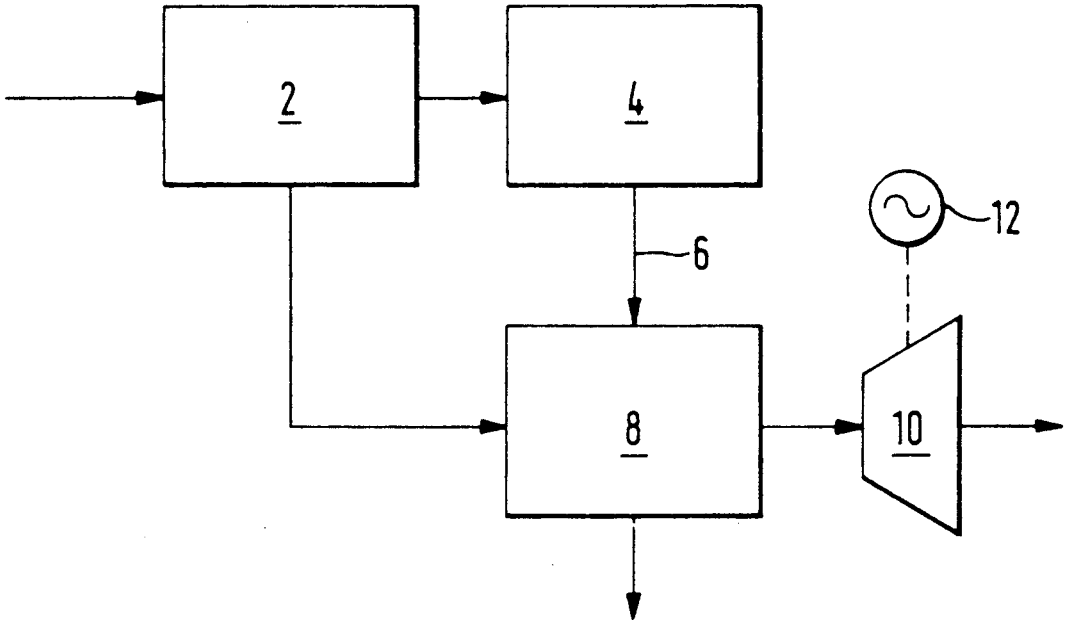
FIG. 1 is a schematic circuit diagram of a combined air separation plant—chemical or metallurgical plant—electrical power generator.

Air is separated in an air separation plant 2 to provide oxygen and nitrogen products which need not be pure. The oxygen product is supplied to a plant 4 in which it is used to take part in a chemical or metallurgical reaction. The plant 4 produces amongst other products a waste gas stream 6 at a temperature of 395° C. This gas stream is then brought into countercurrent heat exchange in heat exchanger 8 with a nitrogen product stream from the air separation plant 2. The nitrogen product stream typically enters the heat exchanger 8 at a pressure of four atmospheres absolute. The resulting nitrogen stream is thereby heated to a temperature of about 350° C. and then enters an expansion turbine 10 where it is expanded with the performance of external work. Typically, the turbine is used to drive an alternator 12 used to generate electrical power, which may be employed in the air separation plant 2 or the chemical/-metallurgical plant 4. Alternatively, the shaft may be directly coupled to compressors used in the air separation plant.

The gas stream from the plant 4 after heat exchange with the nitrogen may typically be vented to the atmosphere through a stack (not shown).

Figure 2:
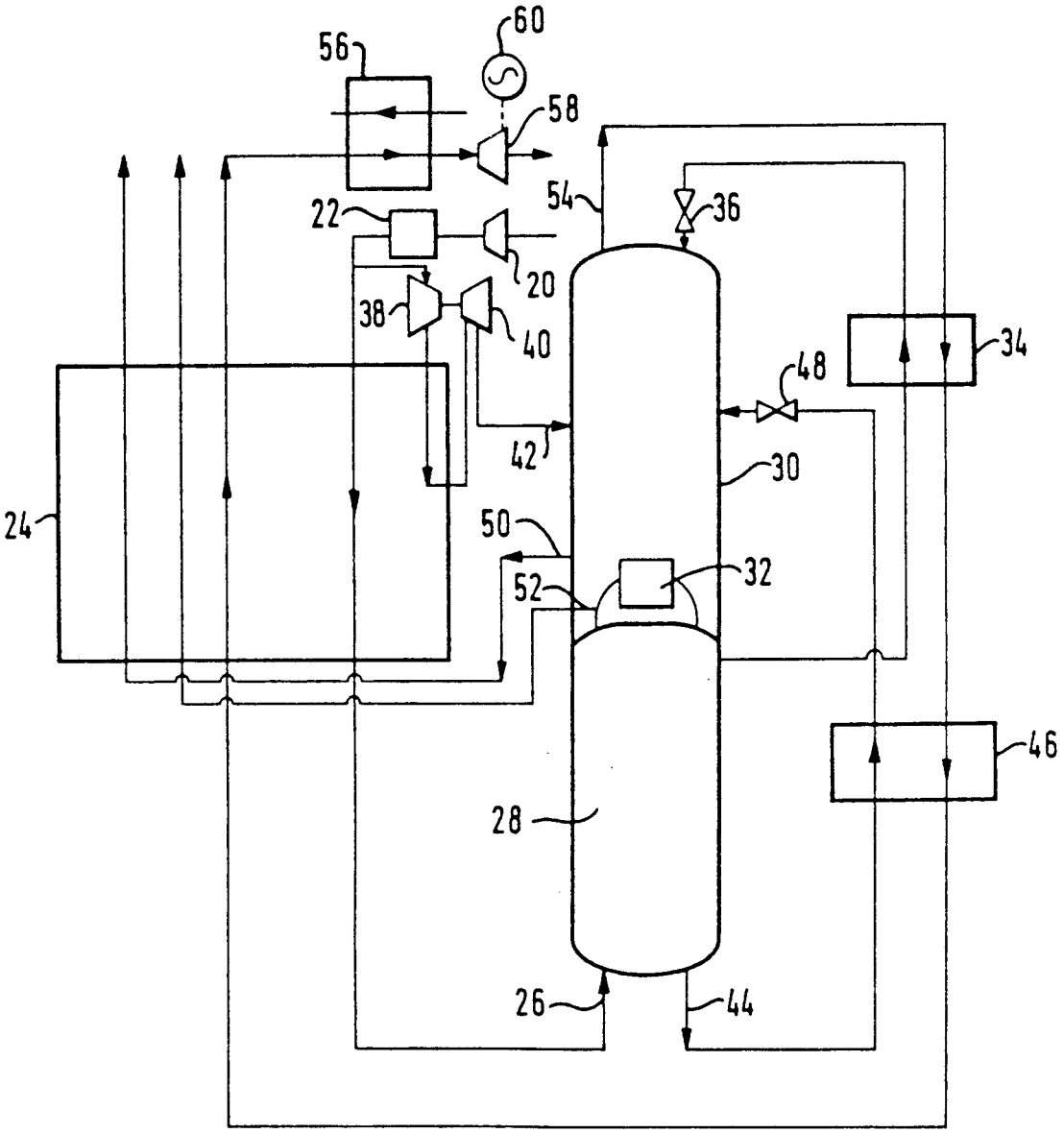
FIG. 2 is a schematic circuit diagram of an air separation plant for use in the apparatus shown in FIG. 1.

Referring to FIG. 2 of the drawings, air is supplied at a chosen pressure from the outlet of an air compressor 20. The air is passed through a purification apparatus 22 effective to remove water vapor and carbon dioxide from the compressed air. The apparatus 22 is of the kind which employs beds of adsorbent to adsorb water vapor and carbon dioxide from the incoming air. The beds may be operated out of sequence with one being generated, typically by means of a stream of nitrogen. The purified air stream is then divided into major and minor streams.

The major stream passes through a heat exchanger 24 in which its temperature is reduced to a level suitable for the separation of the air by cryogenic rectification. Typically therefore the major air stream is cooled to is saturation temperature at the prevailing pressure. The major air stream is then introduced through an inlet 26 into a higher pressure rectification column 28 in which it is separated into oxygen-enriched and nitrogen fractions.

The higher pressure rectification column forms part of a double column arrangement. The other column of the double column arrangement is a lower pressure rectification column 30. Both rectification columns 28 and 30 contain liquid vapor contact trays and associated downcomers (or other means) whereby a descending liquid phase is brought into intimate contact with an ascending vapor phase such that mass transfer occurs between the two phases. The descending liquid phase becomes progressively richer in oxygen and the ascending vapor phase progressively richer in nitrogen. Typically, the higher pressure rectification column 28 operates at a pressure substantially the same as that to which the incoming air is compressed. The column 28 is preferably operated so as to give a substantially pure nitrogen fraction at its top but an oxygen fraction at its bottom which still contains a substantial proportion of nitrogen.

The columns 28 and 30 are linked together by a condenser-reboiler 32. The condenser-reboiler 32 received nitrogen vapor from the top of the higher pressure column 28 and condenses it by heat exchange with boiling liquid oxygen in the column 30. The resulting condensate is returned to the higher pressure column 28. Part of the condensate provides reflux for the column 28 while the remainder is collected, sub-cooled in a heat exchanger 34 and passed into the top of the lower pressure column 30 through an expansion valve 36 and thereby provides reflux for the column 30. The lower pressure rectification column 30 operates at a pressure lower than that of the column 28 and receives oxygen-nitrogen mixture for separation from two sources. The first source is the minor air stream formed by dividing the stream of air leaving the purification apparatus 22. The minor air stream upstream of its introduction into the column 30 is first compressed in a compressor 38, is then cooled to a temperature of about 200K in the heat exchanger 24, is withdrawn from the heat exchanger 24 and is expanded in an expansion turbine 40 to the operating pressure of the column 30, thereby providing refrigeration for the process. This air stream is then introduced into the column 30 through inlet 42. If desired, the expansion turbine 40 may be employed to drive the compressor 38, or alternatively the two machines, namely the compressor 38 and the turbine 40, may be independent of one another. The independent arrangement is often preferred, since it enables the outlet pressure of both machines to be set independently of one another.

The second source of oxygen-nitrogen mixture for separation in the column 30 is a liquid stream of oxygen-enriched fraction taken from the bottom of the higher pressure column 50. This stream is withdrawn through an outlet 44, is sub-cooled in a heat exchanger 46, and is then passed through a Joule-Thomson valve 48 and flows into the column 30 at an intermediate level thereof.

The apparatus shown in the drawing produces three product streams. The first is a gaseous oxygen product stream which is withdrawn from the bottom of the lower pressure column 30 through an outlet 48. This stream is then warmed to at or near ambient temperature in the heat exchanger 24 by countercurrent heat exchange with the incoming air. The oxygen may for example be used in a gasification, steel making or partial oxidation plant and may, if desired, be compressed in a compressor (not shown) to raise it to a desired operating pressure. Two nitrogen product streams are additionally taken. The first nitrogen product stream is taken as vapor from the nitrogen-enriched fraction (typically substantially pure nitrogen) collecting at the top of the column 28. This nitrogen stream is withdrawn through an outlet 52 and is warmed to approximately ambient temperature by countercurrent heat exchange with the air stream in the heat exchanger 24.

The other nitrogen product stream is taken directly from the top of the lower pressure column 30 through an outlet 54. This nitrogen stream flows through the heat exchanger 34 countercurrently to the liquid nitrogen stream withdrawn from the higher pressure column and effects the sub-cooling of this stream. The nitrogen product stream then flows through the heat exchanger 46 countercurrently to the liquid stream of oxygen-enriched fraction and effects the sub-cooling of this liquid stream. The nitrogen stream taken from the top of the column 30 then flows through the heat exchanger 24 countercurrently to the major air stream and is thus warmed to approximately ambient temperature. This nitrogen stream is at least in part heat exchanged in a heat exchanger 56 with a fluid stream embodying low grade heat. The resultant hot nitrogen stream is then expanded in a turbine 58 which is used to drive an alternator 60.

If desired, some of the nitrogen product stream from the lower pressure column may be used to purge the adsorbent beds of water vapor and carbon dioxide in the purification apparatus 22. Such use of nitrogen, which is typically preheated (by means not shown) is well known in the art. The resultant impurity-laden nitrogen may, if desired, be recombined with the nitrogen product stream upstream of the heat exchanger 56.

In a typical operation of the apparatus shown in FIG. 2, the column 28 may operate at about 12.8 bar and the column 30 at about 4.2 bar. Accordingly, the compressor 18 compresses the air to about 13.0 bar and the compressor 38 has an outlet pressure of about 18.2 bar.

Operation of the plan under these conditions to give 30,000 $m^3$/hr tonnes day of at 8 bar and 95% purity and 10,000 $m^3$/hr tonnes per day of nitrogen from the column 28 at 10 bar consumes the following power:

| | MW |
|---|---|
| Air compression | 14.5 |
| Oxygen product compression | 0.9 |
| Total | 15.4 |

However, assuming that 10.4 MW of waste heat are available to the heat exchanger 56 from a fluid stream at 350° C., then 6.7 MW may be recovered from the turbine 58, leaving the net power consumption at 8.7 MW.

This net power consumption compares favorably with operation of comparable plants to produce the same oxygen and nitrogen products in which:

(A) the column 28 is operated at about 6 bar and the column at about 1.3 bar; or (B) the column 28 is operated at about 6 bar and the column 30 at about 1.3 bar and no waste heat is recovered;

(C) the column 28 is operated at about 6 bar and the column 30 at about 1.3 bar and there is no heating of the nitrogen stream. Instead the waste heat stream is used to raise stream which is then expanded in a stream turbine;

(D) the column 28 is operated at about 12.8 bar and the column 30 at about 4.2 bar. No waste heat is transferred to the nitrogen stream, which is expanded to atmospheric pressure from ambient temperature; or (E) the plant is operated as in paragraph D above and waste heat is used to raise stream which is expanded in a stream turbine to recover additional work.

The comparative net power consumptions are shown in the Table below in which all quantities are megawatts (MW).

| | (A) | (B) | (C) | (D) | (E) |
|---|---|---|---|---|---|
| Air compression | 9.5 | 9.5 | 9.5 | 14.5 | 14.5 |
| Oxygen product compression | 2.7 | 2.7 | 2.7 | 0.9 | 0.9 |
| Nitrogen product compression | 5.2 | 0.2 | 0.2 | — | — |
| Total | 17.4 | 12.4 | 12.4 | 15.4 | 15.4 |
| Turbine output | 6.6 | — | 1.6 | 3.1 | 4.7 |
| Net power consumption | 10.8 | 12.4 | 10.8 | 12.3 | 10.7 |

It can thus be appreciated that when work is recovered from nitrogen at an elevated pressure by a process comprising heat exchange if the nitrogen with a fluid stream initially at a temperature of 600° C. or less, which does not change its state during the heat exchange, followed by turbine expansion of the resultant hot nitrogen stream, there is a net power saving over any alternative comparable process.

I claim:

1. A combined process comprising: performing a first process including separating air into oxygen and nitrogen in a distillation column; withdrawing a stream of the oxygen from the distillation column; supplying the stream of the oxygen to a second process that takes place at an elevated temperature and that produces a hot stream of fluid having a temperature of no less than about 200° C. and no greater than about 600° C.; withdrawing a stream of the nitrogen from the distillation column; heating the stream of the nitrogen at a pressure of no less than about 2 atmospheres absolute and no greater than about 7 atmospheres absolute by heat exchange with the hot stream of fluid and without the hot stream of fluid undergoing a change of phase; and expanding the thus heated stream of the nitrogen in a turbine with the performance of external work.

2. The combined process as claimed in claim 1, in which the external work is the production of electricity.

3. The combined process as claimed in claim 1, in which the temperature of the hot stream of fluid is in a range of between about 200° C. and about 400° C.

4. The combined process according to claim 3, in which the pressure of the stream of the nitrogen is in a range of between about 2 atmospheres absolute and about 5 atmospheres absolute.

5. The combined process according to claim 1, in which the second process is an industrial process and the hot stream of fluid is a waste gas stream from the industrial process.

6. The combined process according to claim 5, in which the oxygen is used in the industrial process.

7. The combined process according to claim 1, in which the second process comprises an industrial process and the hot stream of fluid is a heat transfer oil which has been heated without change of phase by a waste gas stream from an industrial process.

8. The combined process according to claim 7, in which the second process comprises an industrial process and the stream of the oxygen is used in said industrial process.

9. The combined process according to claim 1, in which the stream of the nitrogen is not compressed intermediate said distillation column and its heat exchange with said fluid stream.

10. The combined process according to claim 9, in which the distillation column is the lower pressure column of a double column arrangement.

11. A combination comprising: means for separating air into oxygen and nitrogen and for producing a stream of the nitrogen; and a stream of the oxygen means receiving said stream of oxygen for generating a stream of heated fluid having a temperature of no less than about 200° C. and no greater than about 600° C.; a heat exchanger connected to the air separation means and the heated fluid generation means for heat exchanging the stream of the nitrogen at a pressure in a range of between about 2 and about 7 atmospheres with the stream of heated fluid and without said fluid undergoing a change of phase; and an expansion turbine connected to the heat exchanger for expanding the thus heated stream of the nitrogen with the performance of external work.

* * * * *

UNITED STATES PATENT AND TRADEMARK OFFICE

CERTIFICATE OF CORRECTION

PATENT NO. : 5,040,370

DATED : August 20, 1991

INVENTOR(S) : Thomas Rathbone

It is certified that error appears in the above-indentified patent and that said Letters Patent is hereby corrected as shown below:

Column 7, line 1, after the word "nitrogen" delete ";" (the semi-colon) and after the word "oxygen" insert --;--.

Signed and Sealed this

Twenty-sixth Day of October, 1993

*Attest:*

Bruce Lehman

BRUCE LEHMAN

*Attesting Officer*

*Commissioner of Patents and Trademarks*